US008727472B2

(12) United States Patent
Kanzaki

(10) Patent No.: US 8,727,472 B2
(45) Date of Patent: May 20, 2014

(54) IMAGE RECORDING APPARATUS

(71) Applicant: Shotaro Kanzaki, Nagoya (JP)

(72) Inventor: Shotaro Kanzaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/754,002

(22) Filed: Jan. 30, 2013

(65) Prior Publication Data

US 2013/0257946 A1 Oct. 3, 2013

(30) Foreign Application Priority Data

Mar. 30, 2012 (JP) ..... 2012-079116

(51) Int. Cl.
*B41J 2/145* (2006.01)
*B41J 29/38* (2006.01)

(52) U.S. Cl.
USPC ..... 347/12; 347/5

(58) Field of Classification Search
CPC ... B41J 2/0458; B41J 2/04541; B41J 2/04543
USPC ..... 347/12, 5
See application file for complete search history.

(56) References Cited

U.S. PATENT DOCUMENTS 8,439,465 B2 * 5/2013 Mitsuzawa ..... 347/12
8,439,473 B2 * 5/2013 Iriguchi et al. ..... 347/15

FOREIGN PATENT DOCUMENTS

JP 2010-162804 7/2010

* cited by examiner

*Primary Examiner* — Lisa M Solomon
(74) *Attorney, Agent, or Firm* — Scully, Scott, Murphy & Presser, PC

(57) ABSTRACT

With an ink jet head in which color nozzles are aligned with an interval of three times an interval of black nozzles at the right side in a scanning direction of the black nozzles, when an image is recorded by ejecting black ink and color ink superposed on each other, a first unit recording operation is repeatedly executed, in which scanning by ejecting ink from at least one of the black nozzles and color nozzles is repeated three times while moving a carriage in the scanning direction, and a recording sheet is conveyed by a predetermined amount every time scanning is completed. In the first unit recording operation, the carriage is moved to the left side while ink is ejected from both the black nozzles and color nozzles at the first scanning. Moreover, in each of the second and third scanning operations, ink is ejected only from the color nozzles.

8 Claims, 9 Drawing Sheets

IMAGE RECORDING APPARATUS

CROSS-REFERENCE TO RELATED APPLICATIONS

This nonprovisional application claims priority under 35 U.S.C. §119(a) on Patent Application No. 2012-079116 filed in Japan on Mar. 30, 2012, the entire contents of which are hereby incorporated by reference.

TECHNICAL FIELD

The present invention relates to an image recording apparatus in which an image is recorded in a recording medium.

BACKGROUND

Japanese Patent Application Laid-Open No. 2010-162804 discloses an image forming apparatus in which an image is formed by ejecting ink from nozzles while an ink jet head reciprocates in a scanning direction. The image forming apparatus disclosed in Japanese Patent Application Laid-Open No. 2010-162804 comprises nozzles for black arranged at half the interval of nozzles for color, in which the nozzles for black and the nozzles for color eject ink while the ink jet head reciprocates in the scanning direction and a recording sheet is conveyed by the distance corresponding to the interval of five nozzles for black every time a moving direction of a carriage is inverted, to form an image on the recording sheet.

SUMMARY

A case is considered where an image is formed with the image forming apparatus disclosed in Japanese Patent Application Laid-Open No. 2010-162804 by ejecting black ink and color ink superposed on each other. In Japanese Patent Application Laid-Open No. 2010-162804, both black ink and color ink are ejected when the carriage is moved to either side of the scanning direction. This causes the black ink and the color ink to be ejected in one order when the carriage is moved to the right side but in the opposite order when the carriage is moved to the left side. Thus, the resulting image has a mixture of a portion where the image is formed by ejecting color ink after black ink and a portion where the image is formed by ejecting black ink after color ink.

In the case of ejecting black ink and color ink by superposing one on the other, the first-ejected ink spreads out widely on a recording medium because it is ejected on the recording medium where no ink had been ejected. On the contrary, the later-ejected ink does not spread as widely as the first-ejected ink because it is ejected on the recording medium where ink had already been ejected.

Accordingly, in the image formed with the image forming apparatus disclosed in Japanese Patent Application Laid-Open No. 2010-162804, black ink stands out at the portion where the image is formed by ejecting color ink after black ink is ejected, whereas color ink stands out at the portion where the image is formed by ejecting black ink after color ink is ejected. Thus, the image would have non-uniformity between the portion where the black ink stands out and the portion where the color ink stands out, leading to degradation in image quality.

As a method of controlling such that the order of ejecting black ink and color ink is maintained irrespective of portions of a recording medium in the image forming apparatus disclosed in Japanese Patent Application Laid-Open No. 2010-162804, black ink and color ink may be ejected from nozzles only when the carriage is moved to either one of the right side and the left side in the scanning direction. It is alternatively considered that, in the image forming apparatus disclosed in Japanese Patent Application Laid-Open No. 2010-162804, only black ink is ejected from nozzles when the carriage is moved to one of the right side and the left side in the scanning direction, whereas only color ink is ejected from nozzles when the carriage is moved to the side opposite from the above-described one of the right side and the left side in the scanning direction.

In the cases as described above, however, the number of movements of the carriage necessary to record an image increases because no ink is ejected from nozzles when the carriage is moved to the side opposite from the above-described one of the right side and the left side in the scanning direction, or because only one of the black or color ink is ejected every time when the carriage is moved to the right side or to the left side, which increases time required for recording the image.

To solve such a problem, it is an object to provide an image recording apparatus which is capable of recording an image in a significantly short period of time while eliminating non-uniformity between different portions in the recorded image due to a difference in the order of ejecting ink.

An image recording apparatus according to a first aspect is an image recording apparatus, comprising: an ink jet head ejecting ink from a plurality of nozzles; a carriage equipped with the ink jet head and reciprocating in a predetermined moving direction; a conveyance mechanism conveying a recording medium to which ink is ejected from the nozzles in a conveying direction perpendicular to the moving direction; and a control section controlling operations of the ink jet head, the carriage and the conveyance mechanism, wherein the ink jet head is provided with: a plurality of first nozzles aligned with an interval D1 in the conveying direction and ejecting first ink; and a plurality of second nozzles positioned on one side in the moving direction with respect to the plurality of first nozzles and aligned with an interval nD1 (n is an integer larger than 1) in the conveying direction, and ejecting second ink of a type different from the first ink, the control section repeatedly executes a unit recording operation in which the carriage is moved alternately to the one side and to another side in the moving direction for n times, while ink is ejected from at least one of the plurality of first nozzles and the plurality of second nozzles and the conveyance mechanism conveys a recording medium in the conveying direction by a length of (1+mn)D1 (m is 0 or an arbitrary natural number) every time the moving direction of the carriage is inverted, the control section causes both the plurality of first nozzles and the plurality of second nozzles to eject ink at first movement of the carriage in which a direction of the first movement of the carriage is toward the another side or at last movement of the carriage in which a direction of the last movement of the carriage is toward the one side among n movements of the carriage, and the control section causes only the plurality of second nozzles to eject ink at movement of the carriage except for the first movement or the last movement among n movements of the carriage.

According to the first aspect, when ink is ejected from both the plurality of first nozzles and the plurality of second nozzles at the first movement of the carriage in which the direction of the first movement of the carriage is toward another side as a unit recording operation, any portion of an image to be recorded to a recording medium is recorded by ejecting the second ink after the first ink is ejected. When, on the other hand, ink is ejected from both the plurality of first nozzles and the plurality of second nozzles at the last movement of the carriage in which the direction of the last movement of the carriage is toward one side as a unit recording operation, any portion of an image to be recorded to a recording medium is recorded by ejecting the first ink after the second ink is ejected. This can prevent non-uniformity from occurring between regions in an image to be recorded to a recording medium.

Moreover, in the unit recording operation, at least one of the first nozzle and the second nozzle ejects ink when the carriage is moved to each of the directions, and both the first and second nozzles further eject ink at the first or the last movement of the carriage. This can significantly reduce the number of movements of the carriage necessary for recording an image, thereby preventing delay in recording of the image.

According to the first aspect, non-uniformity between regions in the image to be recorded on a recording medium caused by the difference in the order of ejecting the first ink and the second ink can be avoided. This can also largely reduce the number of movements of the carriage necessary for recording an image, thereby preventing delay in recording of the image.

The above and further objects and features will more fully be apparent from the following detailed description with accompanying drawings.

DETAILED DESCRIPTION

A preferred embodiment will be described below.

Figure 1:
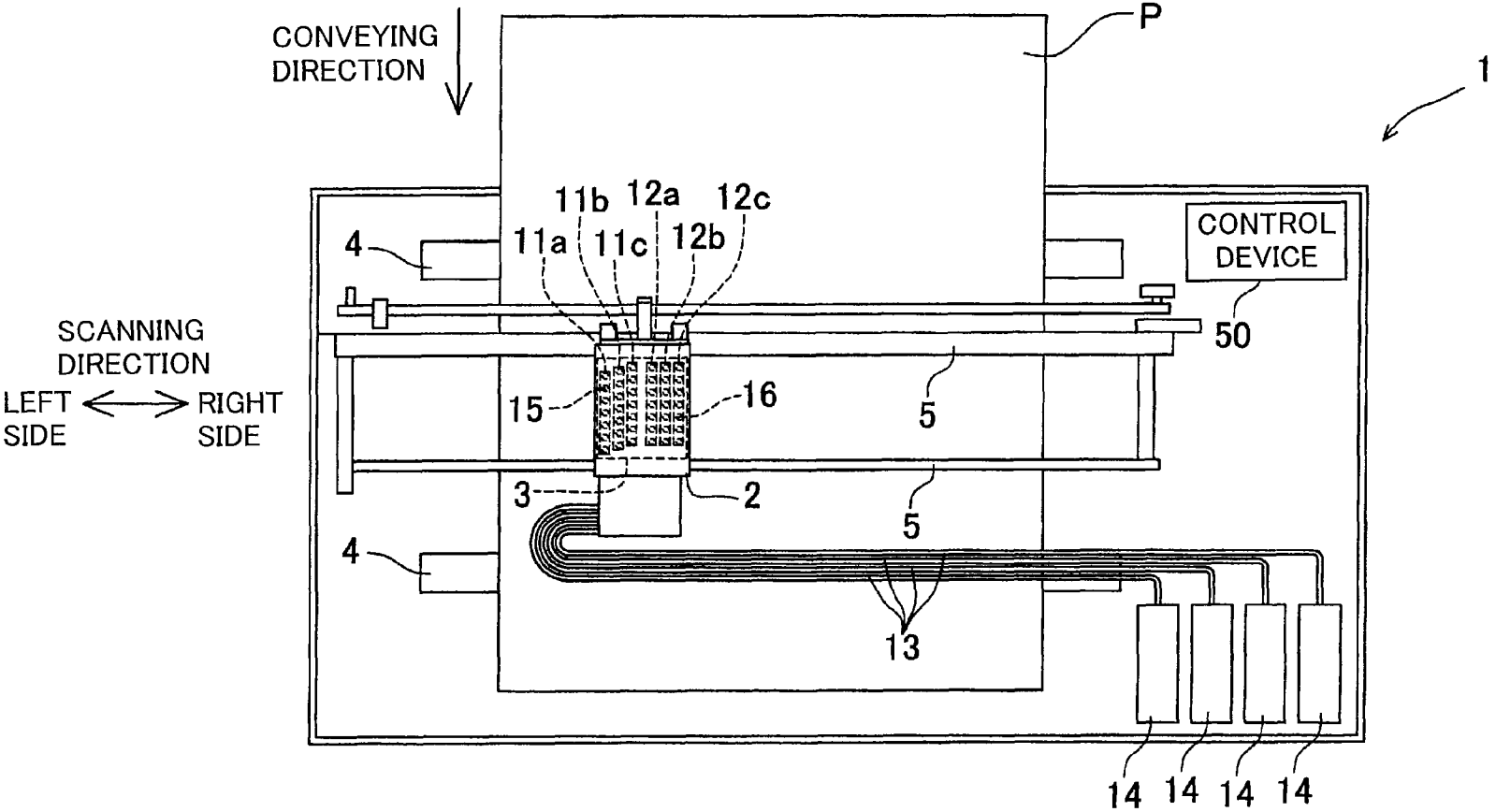
FIG. 1 is a schematic configuration diagram of a printer 1 according to an embodiment.

As shown in FIG. 1, the printer 1 according to the present embodiment comprises a carriage 2, an ink jet head 3, a sheet conveying roller 4 and the like. Moreover, the operation of the printer 1 is controlled by a control device 50.

The carriage 2 reciprocates in a scanning direction along two guide rails 5. Note that the right side and the left side in the scanning direction are defined as shown in FIG. 1 in the description below. The ink jet head 3 is provided with three black head units 11*a* to 11*c*, and three color head units 12*a* to 12*c*.

Figure 2:
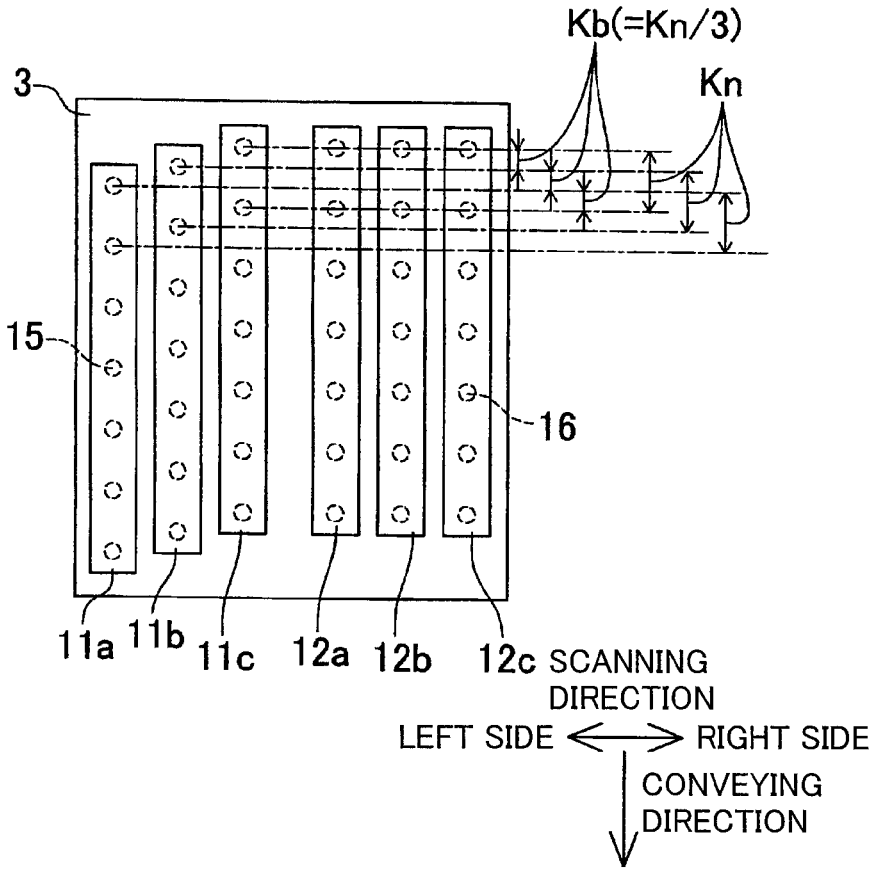
FIG. 2 is a diagram illustrating a positional relationship of nozzles at an ink jet head shown in FIG. 1.

As illustrated in FIG. 2, the three black head units 11*a* to 11*c* are arranged in the scanning direction and respectively include a plurality of black nozzles 15 aligned at an interval Kn in a conveying direction perpendicular to the scanning direction. Moreover, the black head unit 11*b* is arranged at a position displaced from the black head 11*a* toward an upper stream in the conveying direction by an interval Kb which is a third of the interval Kn (=Kn/3). The black head unit 11*c* is arranged at a position displaced from the black head unit 11*b* toward the upper stream in the conveying direction by the interval Kb. Thus, at the ink jet head 3, the black nozzles 15 for the adjacent black head units 11*a* to 11*c* are spaced apart from one another by the interval Kb in the conveying direction.

In the present embodiment, as described above, the three black head units 11*a* to 11*c* each including black nozzles 15 aligned at the interval Kn are spaced apart from one another by the interval Kb in the conveying direction, so that the black nozzles 15 are spaced apart from one another by the interval Kb. It is, however, also possible to provide one black head unit with the black nozzles 15 aligned at the interval Kb instead of the three black head units 11*a* to 11*c*.

The three color head units 12*a* to 12*c* are aligned in the scanning direction and respectively include a plurality of color nozzles 16 aligned at the interval Kn in the conveying direction perpendicular to the scanning direction. Moreover, the three color head units 12*a* to 12*c* are not displaced from one another in the conveying direction, so that the color nozzles 16 of the three color head units 12*a* to 12*c* are positioned at the same positions as the black nozzles 15 of the black head unit 11*c* with respect to the conveying direction.

Furthermore, as shown in FIG. 1, the ink jet head 3 is connected to four ink cartridges 14 through four tubes 13. The four ink cartridges 14 have ink of black, yellow, cyan and magenta stored therein in this order from the right side of the scanning direction. The ink of four colors is supplied to the ink jet head 3 through the tubes 13.

The ink jet head 3 ejects the four-color ink supplied from the ink cartridges 14. More specifically, the black ink is ejected from the black nozzles 15 of the black head units 11*a* to 11*c*, while the ink of yellow, cyan and magenta is ejected from the color nozzles 16 of the color head units 12*a* to 12*c*, respectively.

The sheet conveying roller 4 conveys a recording sheet P in the conveying direction. In the printer 1, the carriage 2 is moved to the right side or to the left side in the scanning direction while scanning in which ink is ejected from the ink jet head 3 mounted on the carriage 2 is repeated, and the recording sheet P is conveyed with the sheet conveying roller 4 in the conveying direction by a predetermined amount every time the moving direction of the carriage 2 is inverted, to record an image on the recording sheet P.

Figure 3:
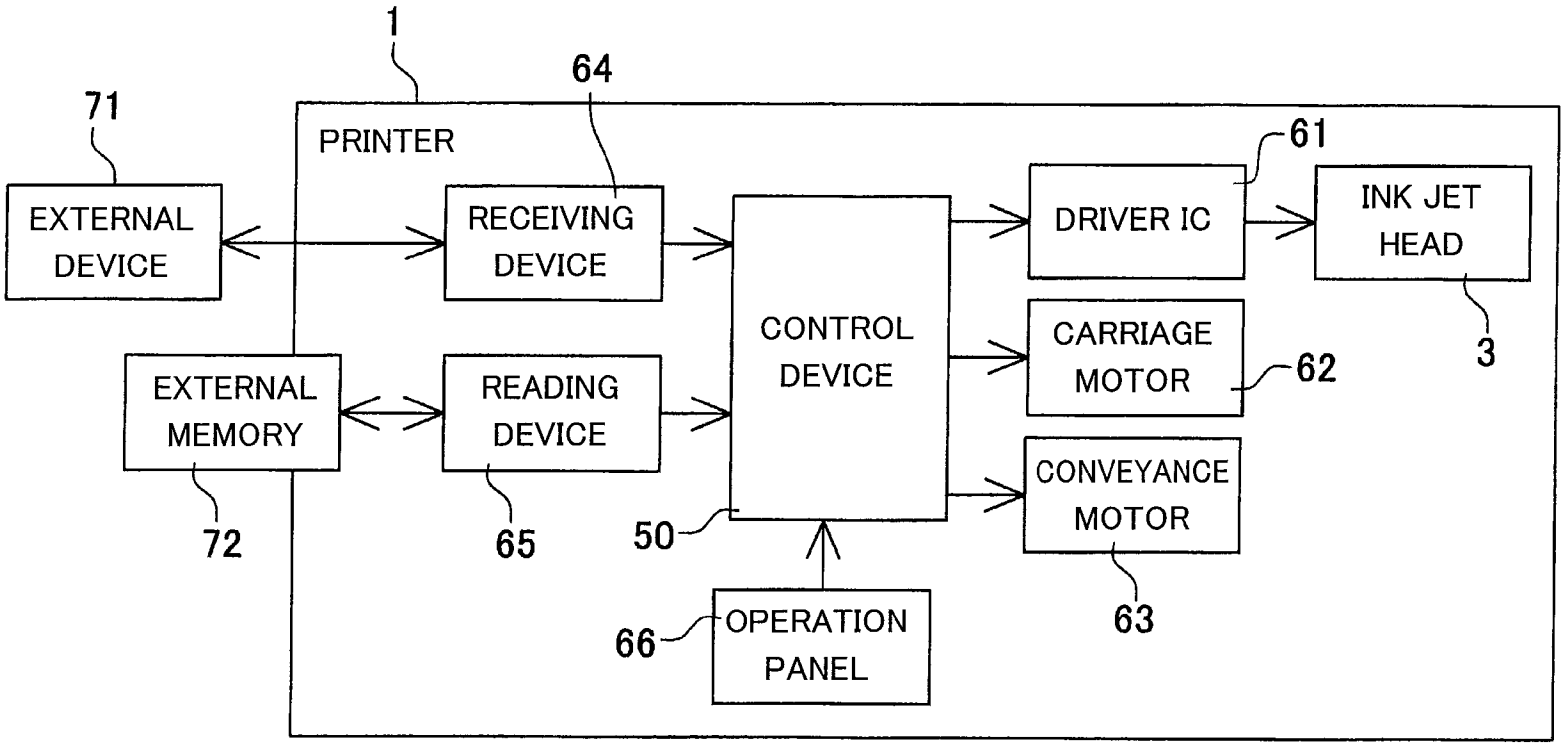
FIG. 3 is a block diagram illustrating a hardware configuration of the printer 1 according to the embodiment.

Next, a hardware configuration of the printer 1 will be described with reference to FIG. 3. As shown in FIG. 3, the printer 1 comprises a control device 50, a driver IC 61, a carriage motor 62, a conveyance motor 63, an ink jet head 3, a receiving device 64, a reading device 65 and an operation panel 66.

The receiving device 64 may be an interface for receiving various types of data transmitted from an external device 71 such as a PC to the printer 1. More specifically, a well-known network card, a USB device controller or the like may be used. The reading device 65 may be a controller for reading various types of data stored in an external memory 72 such as a portable storage like a memory card or an internal memory of a digital camera. More specifically, a well-known memory controller, a USB host controller or the like may be used. The operation panel 66 includes a display and various types of operation buttons for operation by the user. The user can operate the operation panel 66 to input various instructions to the printer 1.

The control device 50 includes various types of control circuits including a CPU (Central Processing Unit), a ROM (Read Only Memory), a RAM (Random Access Memory), ASIC and the like. The control device 50 performs various types of processing such as recording control processing, image data acquisition processing, mode information acquisition processing, determination processing and the like in accordance with various types of programs stored in a memory such as ROM or RAM.

The recording control processing is for controlling the operations of the driver IC 61 for driving the ink jet head 3, the carriage motor 62 for moving the carriage 2, the conveyance motor 63 for driving the sheet conveying roller 4 and the like when an image is recorded at the printer 1. The control device 50 controls the driver IC 61, the carriage motor 62, the conveyance motor 63 and the like to selectively record an image in any one of the first to third recording modes, which will be described later.

The image data acquisition processing is for acquiring image data transmitted from the external device 71 such as a PC to the printer 1. The control device 50 may also acquire image data through the receiving device 64 described above. The external device 71 such as a PC creates image data which can be printed at the printer 1 when, for example, the user gives an instruction to print a desired electronic file, and transmits the created image data to the printer 1. Note that the image data may be data described in a page descriptive language or may be data of an image file in a predetermined format such as JPEG which can be decrypted by the printer 1.

The mode information acquisition processing is for acquiring mode information indicating which one of the first to third recording modes described later is set to record an image on a recording sheet P. The control device 50 may acquire the mode information through the receiving device 64 described above. It is noted that the mode information in the present embodiment may be data created by the printer driver of the external device 71 when an instruction for printing is given by the external device 71 such as a PC. The external device 71 transmits the mode information along with the image data described above to the printer 1. Note that the mode information acquired by the control device 50 may be data described in a page descriptive language or may be data described at the header of an image file in a predetermined format such as JPEG.

The printer driver in the external device 71 may generate mode information, indicating which recording mode is set for printing, in accordance with various types of print setting and a file format of an original electronic file. For example, it may be so configured that the user can select a desired recording mode among the first to third recording modes with a GUI of the printer driver and that the printer driver generates mode information based on the selected recording mode. The user may directly set a desired recording mode among the first to third recording modes.

Moreover, instead of the user directly setting any one of the first to the third recording modes, the printer driver may generate mode information indicating any one of the first to third recording modes based on print setting of another item input by the user. For example, it may be configured that "monochrome/color setting" can be selected on the GUI of the printer driver. In the item of "monochrome/color setting," either one of "monochrome printing" or "color printing" may be selected for print setting. When "monochrome printing" is being set, the printer driver may generate mode information indicating the third recording mode. When, on the other hand, "color printing" is being set, the printer driver may generate mode information indicating one of the first recording mode and the second recording mode based on the file format of an original electronic file designated for printing. More specifically, in the case of forming a file such as spreadsheet software or word processing software that uses characters, mode information indicating the first recording mode may be generated. If, on the other hand, the file format of the original electronic file is an image file such as TIFF or GIF, mode information indicating the second recording mode may be generated.

The determination processing is to determine which one of the first to third recording modes described later is set to record an image on a recording sheet P in the printer 1 based on the mode information acquired at the mode information acquisition processing. The details of the determination processing will be described later.

Figure 4:
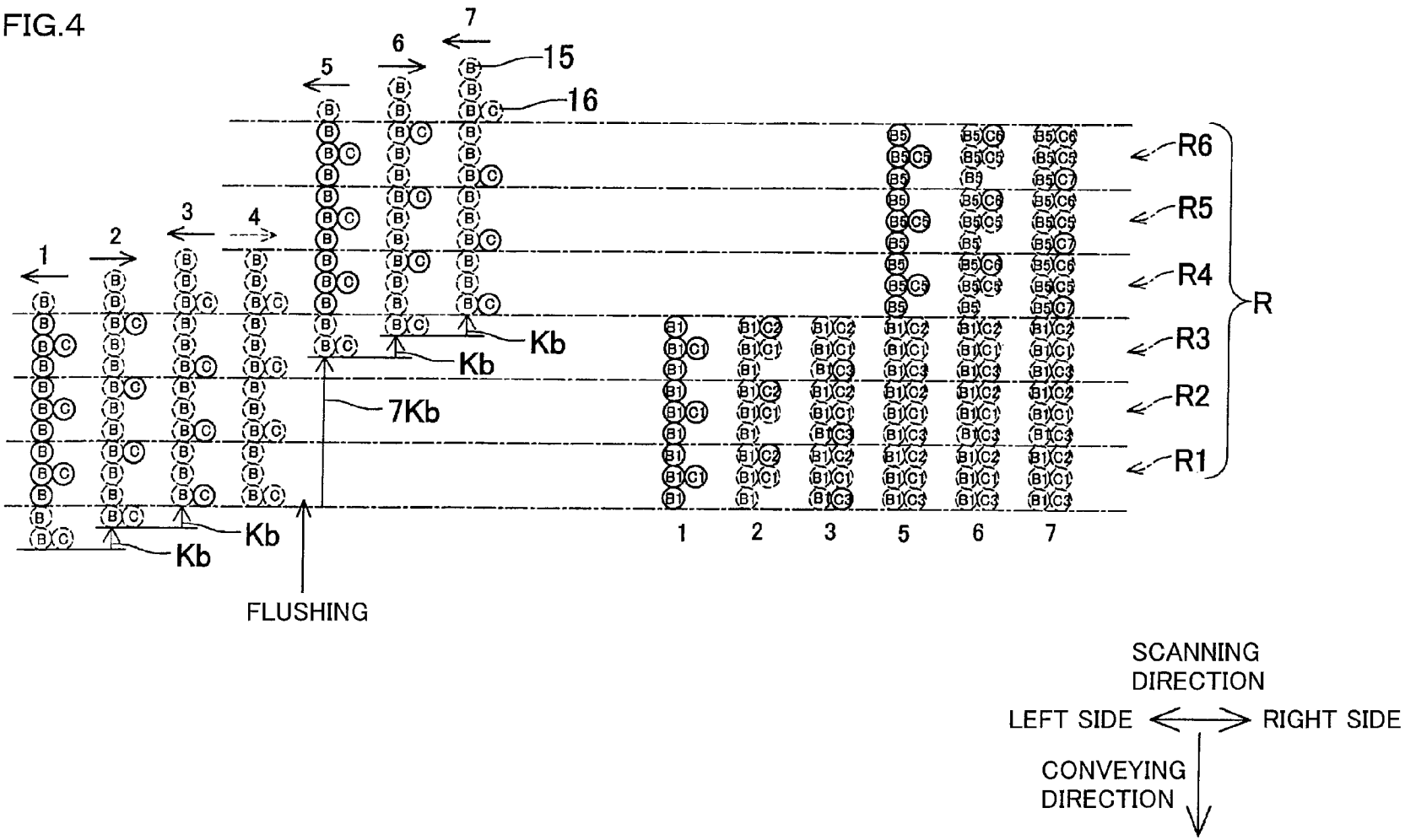
FIG. 4 is a diagram illustrating nozzles for ejecting ink and positions where ink is ejected when an image is recorded in the first recording mode.

Recording of an image in the first to third recording modes as described above will now be described. The first recording mode is to record a color image by ejecting black ink and color ink superposed on one another on a recording sheet P. The left side view in FIG. 4 schematically shows a positional relationship of black nozzles 15 and color nozzles 16 in each scanning operation of the first recording mode as well as the black nozzles 15 and color nozzles 16 ejecting ink. In the left side view of FIG. 4, the circled "B" and "C" correspond to the black nozzles 15 for the three black head units 11*a* to 11*c* and to the color nozzles 16 for the three color head units 12*a* to 12*c*, respectively. Each of the numbers 1 through 7 at the upper side on the left side view of FIG. 4 indicates which number of times the scanning corresponds to. The arrow shown below each of the numbers indicates a moving direction of the carriage 2 in each scanning operation. Moreover, in the left side view of FIG. 4, the black nozzles 15 and color nozzles 16 ejecting ink at each scanning are indicated by solid lines, while the black nozzles 15 and color nozzles 16 not ejecting ink are indicated by broken lines.

The right side view in FIG. 4 schematically shows a eject state of ink when an image is recorded in the first recording mode. In the right side view of FIG. 4, the circled "B" and "C" correspond to ink ejected from the black nozzles 15 and ink ejected from the color nozzles 16, respectively. Moreover, each of the numbers described alongside "B" and "C" indicates which number of times the scanning corresponds to when ink is ejected. Furthermore, each of the numbers 1 through 7 at the lower side of the right side view in FIG. 4 indicates the number of times the scanning is performed immediately before the ink is ejected. In addition, a position where ink is ejected, i.e. ejection position, in each scanning is indicated by the solid line whereas a position where ink is ejected prior to that is indicated by a broken line. In the right side view of FIG. 4, though the ejection position for black ink and the ejection position for color ink are illustrated side by side in the scanning direction, the black ink and color ink are ejected so as to be superposed on each other at least on one portion of a recorded image.

Though, at the printer 1, in practice, a recording sheet P is conveyed in the conveying direction without a change in the position of the ink jet head 3 in the conveying direction, the position of the recording sheet P is fixed in FIG. 4 to show the position of the ink jet head 3 on the basis of the recording sheet in order to clearly indicate the position where ink is ejected on the recording sheet P. Moreover, FIG. 4 shows an example where an image is recorded in a region R in which eighteen dots are aligned in the conveying direction of the recording sheet P. Furthermore, regions R1 through R6 shown in FIG. 4 are formed by dividing the region R into six regions in the conveying direction, and in each of the regions R1 through R6, three dots are aligned in the conveying direction.

In the first recording mode, the first scanning is executed in which ink is ejected from the black nozzles 15 and the color nozzles 16 while moving the carriage 2 to the left side. Thereafter, a recording sheet P is conveyed in the conveying direction by the same length as the interval Kb. Subsequently, the second scanning is executed in which ink is ejected only from the color nozzles 16 while the carriage 2 is moved to the right side. Thereafter, the recording sheet P is conveyed by the same length as the interval Kb. Subsequently, the third scanning is executed in which ink is ejected only from the color nozzles 16 while moving the carriage 2 to the left side. In the first to third scanning as described above, ink is ejected only from the black nozzles 15 and color nozzles 16 set in the regions R1 through R3 among the black nozzles 15 and the color nozzles 16. Accordingly, the first unit recording operation including the series of scanning operations allows the printer 1 to record an image in the regions R1 through R3 with a resolution corresponding to the interval Kb of the black nozzles 15.

Next, as the fourth scanning, blank scanning is executed in which the carriage 2 is moved to the right side at a speed higher than that in the first to third scanning operations without ejecting ink from the black nozzles 15 and color nozzles 16. Thereafter, at the position where the ink jet head 3 is not opposed to the recording sheet P, flushing is executed in which ink is ejected from the black nozzles 15. Moreover, while the blank scanning and the subsequent flushing are executed, the recording sheet P is conveyed by the length of 7 Kb which is seven times the interval Kb, i.e. by the length of Kb+2Kn which is obtained by adding a value corresponding to twice the interval Kn to the interval Kb.

Subsequently, the first unit recording operation is executed again. That is, the fifth through seventh scanning operations are executed as in the first through third scanning operations, and the recording sheet P is conveyed by the same interval as the interval Kb after the fifth and sixth scanning operations. Note that, in the fifth through seventh scanning operations, ink is ejected only from the black nozzles 15 and color nozzles 16 that are set in the regions R4 through R6. This allows the printer 1 to record an image with a resolution corresponding to the interval Kb of the black nozzles 15 in the regions R4 through R6.

It is noted that, when an image is recorded in a region longer than the region shown in FIG. 4 in the conveying direction, thereafter, the blank scanning and the subsequent flushing are further executed while the recording sheet P is conveyed by the length 7 Kb during the blank scanning and flushing. From then on, the first unit recording operation, blank scanning, flushing, and conveyance of the recording sheet P during the blank scanning and flushing are repeatedly executed in accordance with the length related to the conveying direction of the region in which an image is to be recorded.

Figure 5:
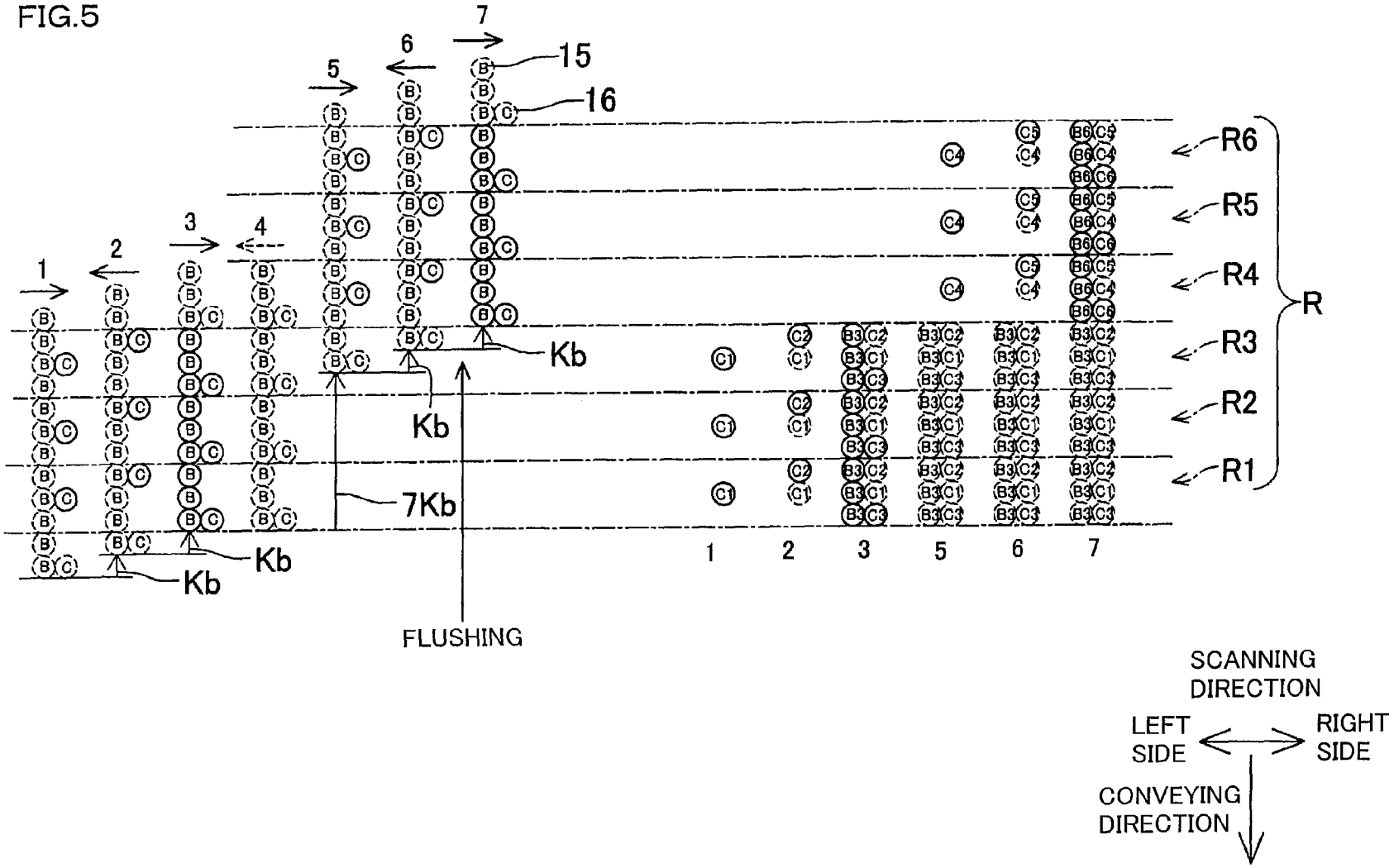
FIG. 5 is a diagram illustrating nozzles for ejecting ink and positions where ink is ejected when an image is recorded in the second recording mode.

The second recording mode is different from the first recording mode and is for recording a color image by ejecting black ink and color ink superposed on one another on a recording sheet P. FIG. 5 is a diagram corresponding to FIG. 4 in the second recording mode.

In the second recording mode, the first scanning is executed in which ink is ejected only from the color nozzles 16 while moving the carriage 2 to the right side, and thereafter the recording sheet P is conveyed by the same length as the interval Kb in the conveying direction. Subsequently, the second scanning is executed in which ink is ejected only from the color nozzles 16 while moving the carriage 2 to the left side, and thereafter the recording sheet P is conveyed by the same length as the interval Kb. Moreover, while the recording sheet P is being conveyed, flushing, in which ink is ejected from the black nozzles 15, is executed at a position where the ink jet head 3 is not opposed to the recording sheet P. Subsequently, the third scanning is executed in which ink is ejected from both the black nozzles 15 and color nozzles 16 while moving the carriage 2 to the right side. In the first to third scanning operations as described above, ink is ejected only from the black nozzles 15 and color nozzles 16 that are set in the regions R1 through R3 among the black nozzles 15 and color nozzles 16. Accordingly, the second unit recording operation including the series of scanning operations allows the printer 1 to record an image in the regions R1 through R3 with a resolution corresponding to the interval Kb of the black nozzles 15.

Next, as the fourth scanning, blank scanning is executed in which the carriage 2 is moved to the right side at a speed higher than that in the first to third scanning operations without ejecting ink from the black nozzles 15 and color nozzles 16. During that time, the recording sheet P is conveyed by the length of 7 Kb which is seven times the interval Kb.

Subsequently, the second unit recording operation is executed again. That is, the fifth through seventh scanning operations are executed as in the first through third scanning operations, and the recording sheet P is conveyed by the same interval as the interval Kb after the fifth and sixth scanning operations. Moreover, after the sixth scanning and before the seventh scanning, flushing is executed. Note that, in the fifth through seventh scanning operations, ink is ejected only from the black nozzles 15 and color nozzles 16 that are set in the regions R4 through R6. This allows the printer 1 to record an image with a resolution corresponding to the interval Kb of the black nozzles 15 in the regions R4 through R6.

Note that, when an image is recorded in a region longer than the region shown in FIG. 5 in the conveying direction, blank scanning is further executed while the recording sheet P is conveyed by the length of 7 Kb. From then on, the second unit recording operation, blank scanning and conveyance of the recording sheet P during the blank scanning are repeatedly executed in accordance with the length related to the conveying direction of the region in which an image is recorded, to record an image on the recording sheet P.

Figure 6:
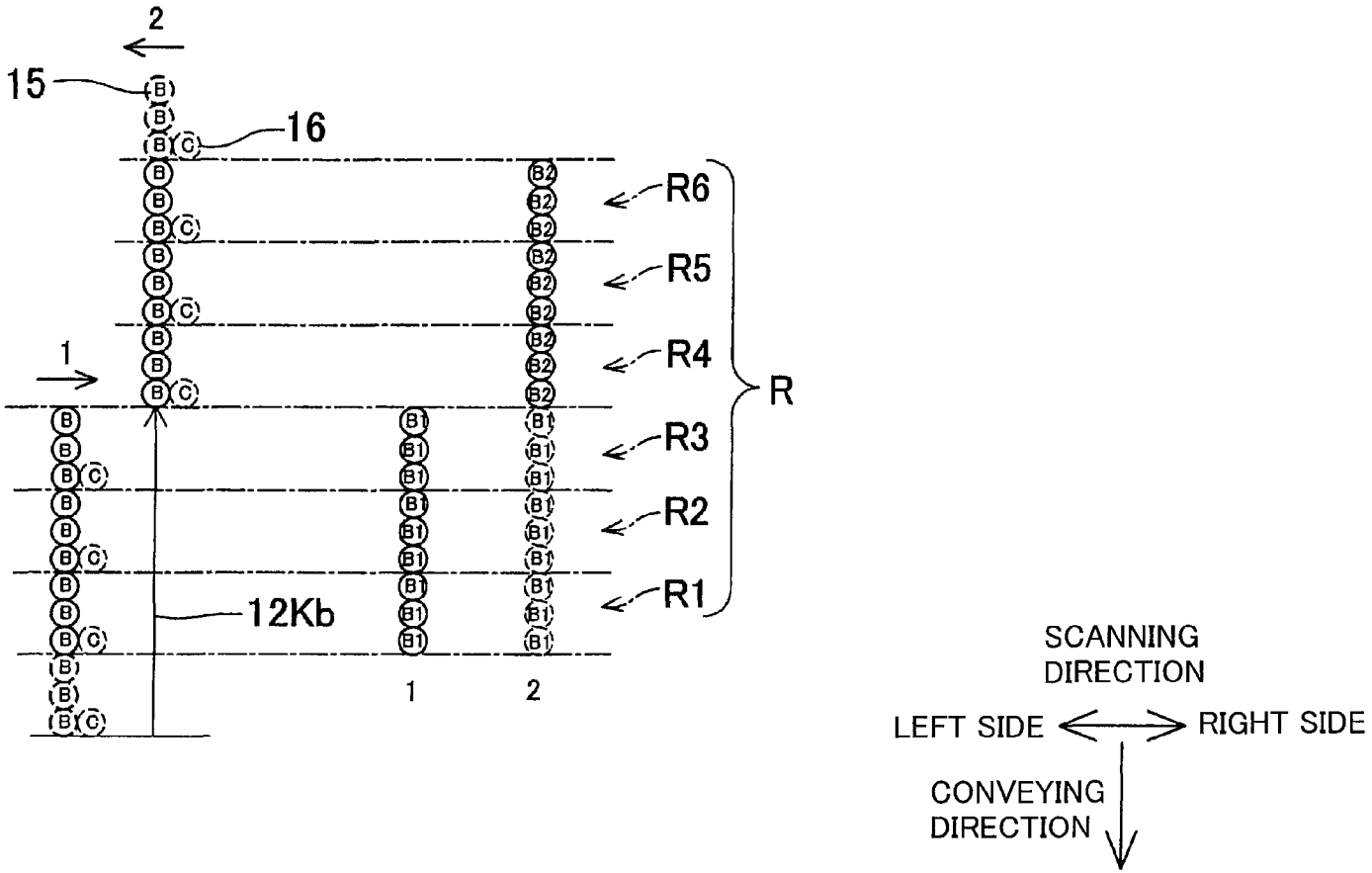
FIG. 6 is a diagram illustrating nozzles for ejecting ink and positions where ink is ejected when an image is recorded in the third recording mode.

The third recording mode is for recording a monochrome image by using only black ink. FIG. 6 is a diagram corresponding to FIG. 4 in the third recording mode.

In the third recording mode, the first scanning is executed in which ink is ejected from the black nozzles 15 while moving the carriage 2 to the right side. Note that, in the first scanning, ink is ejected only from the black nozzles 15 set in the regions R1 through R3 in relation to the conveying direction.

Next, the recording sheet P is conveyed in the conveying direction by the length of a row of black nozzles 15, i.e. by the lengths of 12 Kb which is twelfth times the interval Kb. Subsequently, the second scanning is executed in which ink is ejected from the black nozzles 15 while moving the carriage 2 to the left side. In the second scanning, ink is ejected only from the black nozzles 15 that are set in the regions R4 through R6 in relation to the conveying direction.

By thus recording an image, the first scanning allows the printer 1 to record a monochrome image in the regions R1 through R3 with a resolution corresponding to the interval Kb of the black nozzles 15 in relation to the conveying direction. Furthermore, the second scanning allows the printer 1 to record a monochrome image in the regions R4 through R6 with a resolution corresponding to the interval Kb of the black nozzles 15 in relation to the conveying direction. That is, the monochrome image can be recorded at a speed higher than that in the first or second recording mode and with the same resolution as that in the first or second recording mode.

It is noted that, when an image is recorded in a region longer in the conveying direction than the region R shown in FIG. 6, the above-described scanning and conveying of the recording sheet P are alternately executed for a number of times corresponding to the length of a region in which an image is to be recorded.

While an image can selectively be recorded at any one of the first to third recording modes, an image formed by ejecting black ink and color ink superposed on one another is recorded both in the first recording mode and the second recording mode. The difference between the quality of an image recorded in the first recording mode and the quality of an image recorded in the second recording mode will be described.

When an image is recorded in the first recording mode, ink is ejected from both the black nozzles 15 and color nozzles 16 at the first scanning in each first unit recording operation, and then ink is ejected only from the color nozzles 16 in the subsequent scanning. Moreover, since the black nozzles 15 are positioned on the left side of the carriage 2 and the carriage 2 moves to the left side in the first scanning, black ink is first ejected and then color ink is ejected at the first scanning in the first unit recording operation. In the first unit recording operation, therefore, black ink is first ejected on the recording sheet P on which no ink have been ejected and thereafter color ink is ejected on the recording sheet P on which the black ink have already been ejected.

Thus, at a portion on the recording sheet P where black ink and color ink are superposed on each other, the black ink is ejected on the recording sheet P which has no ink ejected thereon, and spreads out widely over the recording sheet P. On the other hand, color ink is ejected on the recording sheet P on which black ink has already been ejected, so that it does not spread as widely as the black ink on the recording sheet P. When, therefore, an image is recorded in the first recording mode, an image with black ink standing out is recorded.

When, on the other hand, an image is recorded in the second recording mode, in each second unit recording operation, ink is ejected only from the color nozzles 16 at scanning other than the last scanning, and thereafter, ink is ejected from both the black nozzles 15 and color nozzles 16 in the last scanning. Furthermore, since the black nozzles 15 are positioned on the left side of the carriage 2 and the carriage 2 moves to the right side in the last scanning, color ink is first ejected and then black ink is ejected in the last scanning in the second unit recording operation. In each second unit recording operation, therefore, color ink is first ejected on the recording sheet P with no ink being ejected and thereafter black ink is ejected on the recording sheet P on which color ink has already been ejected.

Thus, at a portion on the recording sheet P where black ink and color ink are superposed on each other, the color ink is ejected on the recording sheet P which has no ink ejected thereon, and spreads out widely over the recording sheet P. On the other hand, black ink is ejected on the recording sheet P on which color ink has already been ejected, so that it does not spread as widely as the color ink on the recording sheet P. When, therefore, an image is recorded in the second recording mode, an image with color ink standing out is recorded.

Furthermore, an image recorded in the first recording mode is formed by ejecting color ink after ejecting black ink at any portion. On the other hand, an image recorded in the second recording mode is formed by ejecting black ink after ejecting color ink at any portion. Thus, an image recorded in the first recording mode or the second recording mode will not have a mixture of a portion in which black ink stands out which is recorded by first ejecting black ink and then ejecting color ink and a portion in which color ink stands out which is recorded by first ejecting color ink and then ejecting black ink. Hence, non-uniformity between portions can be prevented from occurring in a recorded image.

As an image recording method that can prevent non-uniformity due to the difference between the order of ejecting black ink and the order of ejecting color ink from occurring between portions in a recorded image, other than the image recording method using the first and second recording modes as described above, for example, such a method may be considered that both black ink and color ink are ejected only when a carriage is moved to either one of the right and left sides in the scanning direction. With this method, however, ink will not be ejected from any one of the black nozzles 15 and color nozzles 16 at half the number of times for the repeatedly executed scanning operations. This increases the number of times the carriage 2 is required to move for recording an image, which further increases time required for recording the image.

Another possible method is to eject only black ink when a carriage is moved to one of the right and left sides in the scanning direction and to eject only color ink when the carriage 2 is moved to the direction opposite from the above. In this case, however, ink is ejected only from one of the black nozzles 15 and color nozzles 16 in each of the scanning operations. This increases the number of times the carriage 2 is required to move for recording an image, which further increases time required for recording the image.

In the case of the present embodiment, on the other hand, ink is ejected from the color nozzles 16 in each of the scanning operations in the first and second unit recording operations. Furthermore, in the first unit recording operation, ink is ejected from both the black nozzles 15 and color nozzles 16 in the first scanning, whereas, in the second unit recording operation, ink is ejected from both the black nozzles 15 and color nozzles 16 in the last scanning. Thus, the number of times the carriage 2 is required to move for recording an image can be reduced compared to the cases as described above. An image can, therefore, be recorded in a significantly short period of time.

Moreover, in the first and second unit recording operations, ink in the color nozzles 16 is not easily dried because ink is ejected from the color nozzles 16 at all the three scanning operations. On the other hand, ink is ejected from the black nozzles 15 at only one of the three scanning operations. Thus, ink in the black nozzles 15 may be dried by the time the ink is to be ejected next from the black nozzles 15 after ink has been ejected from the block nozzles 15, possibly preventing the black nozzles 15 from normally ejecting ink.

In the present embodiment, flushing is executed after the first unit recording operation, before the subsequent first unit recording operation and immediately before the last scanning in the second unit recording operation. Thus, dryness of ink in the black nozzles 15 is eliminated, allowing the black nozzles 15 to normally eject ink in the first and second unit recording operations.

Moreover, when the color nozzles 16 are aligned with an interval which is three times the interval of the black nozzles 15 as in the present embodiment, three scanning operations are executed in the first and second unit recording operations. Thus, the carriage 2 moves in the same direction both in the first and last scanning operations. In the present embodiment, therefore, blank scanning is executed after the first and second unit recording operations and before the subsequent first and second unit recording operations, so that the first and second unit recording operations can be executed in series. Furthermore, as the moving speed of the carriage 2 in the blank scanning is made faster than that of the carriage 2 at scanning in the first or second unit recording operation, the time required for recording an image can be shortened.

The printer 1 according to the present embodiment records an image in any one of the first to third recording modes as described above. The operation of the control device 50 when an instruction for recording is received from the external device 71 will now be described with reference to FIG. 7.

Figure 7:
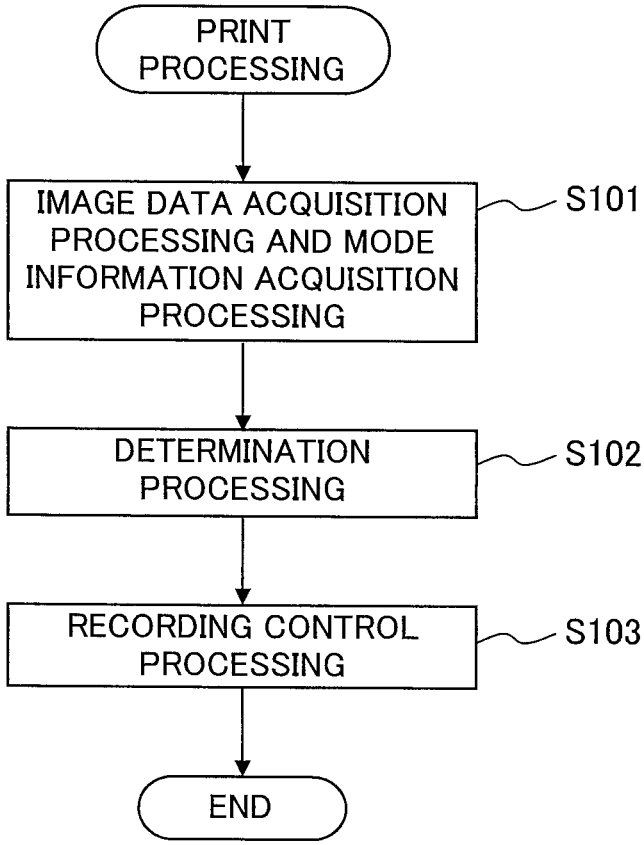
FIG. 7 is a flowchart illustrating a procedure of print processing.

When the receiving device 64 receives an instruction for recording image data, the control device 50 starts print processing as shown in FIG. 7. When the print processing is started, the control device 50 performs image data acquisition processing and mode information acquisition processing (S101). After acquiring image data by the image data acquisition processing and mode information by the mode information acquisition processing, the control device 50 performs determination processing (S102). After determining which recording mode is set to record image data in the determination processing, the control device 50 performs record control processing based on the recording mode determined at S102 (S103). It is noted that, when more than one pieces of image data are divided to be received in response to one printing instruction, acquisition of the subsequent image data and recording of the image data are repeatedly executed at S103.

In the present embodiment, an image can be recorded in a desired one of the first to third recording modes. In the third recording mode, a monochrome image can promptly be recorded with a high resolution. In the first recording mode, on the other hand, visibility of a character and the like can be increased when an image including a character and the like is recorded as a color image. This is advantageous when, for example, an image to be recorded includes a table with a background color and printing is performed for a file used in spreadsheet software or the like which is assumed to preferably have high visibility for characters by highlighting characters in the table. In the second recording mode, on the other hand, when the duty of jetted ink is high, such as when an acquired file format is for photograph, black nozzles can be prevented from drying and thus a clear image can be recorded.

It is noted that, in the present embodiment, the black nozzles 15 correspond to the first nozzles described in Claims, and the color nozzles 16 correspond to the second nozzles described in Claims. Moreover, the sheet conveying roller 4 corresponds to the conveyance mechanism described in Claims. Furthermore, the interval Kb corresponds to the interval D1 described in Claims, whereas the interval Kn corresponds to the interval nD1 (n is an integer larger than 1) described in Claims.

Next, a modification will be described, which adds various changes to the present embodiment. Note that a structure similar to that in the present embodiment will not be described accordingly.

Though the embodiment above described that the control device 50 acquires information directly indicating a recording mode itself as mode information at S101, an employable configuration is not limited thereto. For example, information regarding another print setting may also be used as the mode information described above. More specifically, information regarding setting of two items, i.e., "monochrome/color setting" and "character setting," may also be used as the mode information. The item "monochrome/color setting" is the same as the one described above. At the item "character setting," it may be so configured that one of the print setting between "highlight characters" and "prioritize image such as photograph" can be selected.

Here, at S101 described above, the control device 50 acquires the information regarding the setting as mode information through the receiving device 64 described above. It is not necessary for the user to be able to directly set for "character setting." For example, a printer driver may perform such setting based on a file format of an original image file for which printing instruction is given.

Moreover, though the embodiment above described that the control device 50 acquires information directly indicating a recording mode itself as the mode information, an employable configuration is not limited thereto. For example, image data itself may be used as the mode information.

Here, the control device 50 acquires only image data at S101 described above. Thereafter, at S102, the control device 50 determines which one of the first to third recording modes is set for recording based on the image data acquired at S101. More specifically, it is determined (i) which one of the monochrome image recording and color image recording is suitable, (ii) whether or not it is preferable to highlight characters, and the like from the image acquired at S101. The determination for (i) is made, for example, based on whether or not image data includes data other than black. The determination for (ii) is made, for example, by pattern matching for searching whether or not a character is included in a received image.

Moreover, though the embodiment above described that the control device 50 obtains image data through the receiving device 64, an employable configuration is not limited thereto. For example, image data may be acquired from the external memory 72 such as a memory card through the reading device 65. In this case, when the user connects the external memory 72 to the reading device 65 and then instructs through an operation panel 66 for printing of image data stored in the external memory 72, the control device 50 starts print processing described above.

Here, the control device 50 acquires image data through the reading device 65 at S101. Note that the external memory 72 does not need to have mode information pre-recorded therein. The operation panel 66 may accept mode information selected by the user on its print instruction screen. The control device 50 acquires mode information through the operation panel 66.

Though it was described that a recording mode can directly be designated with the operation panel 66, another setting may be used to indirectly designate a recording mode. Alternatively, instead of designating a recording mode by operation with the operation panel 66, the image data acquired at S101 may be analyzed and a recording mode may automatically be determined.

Figure 8:
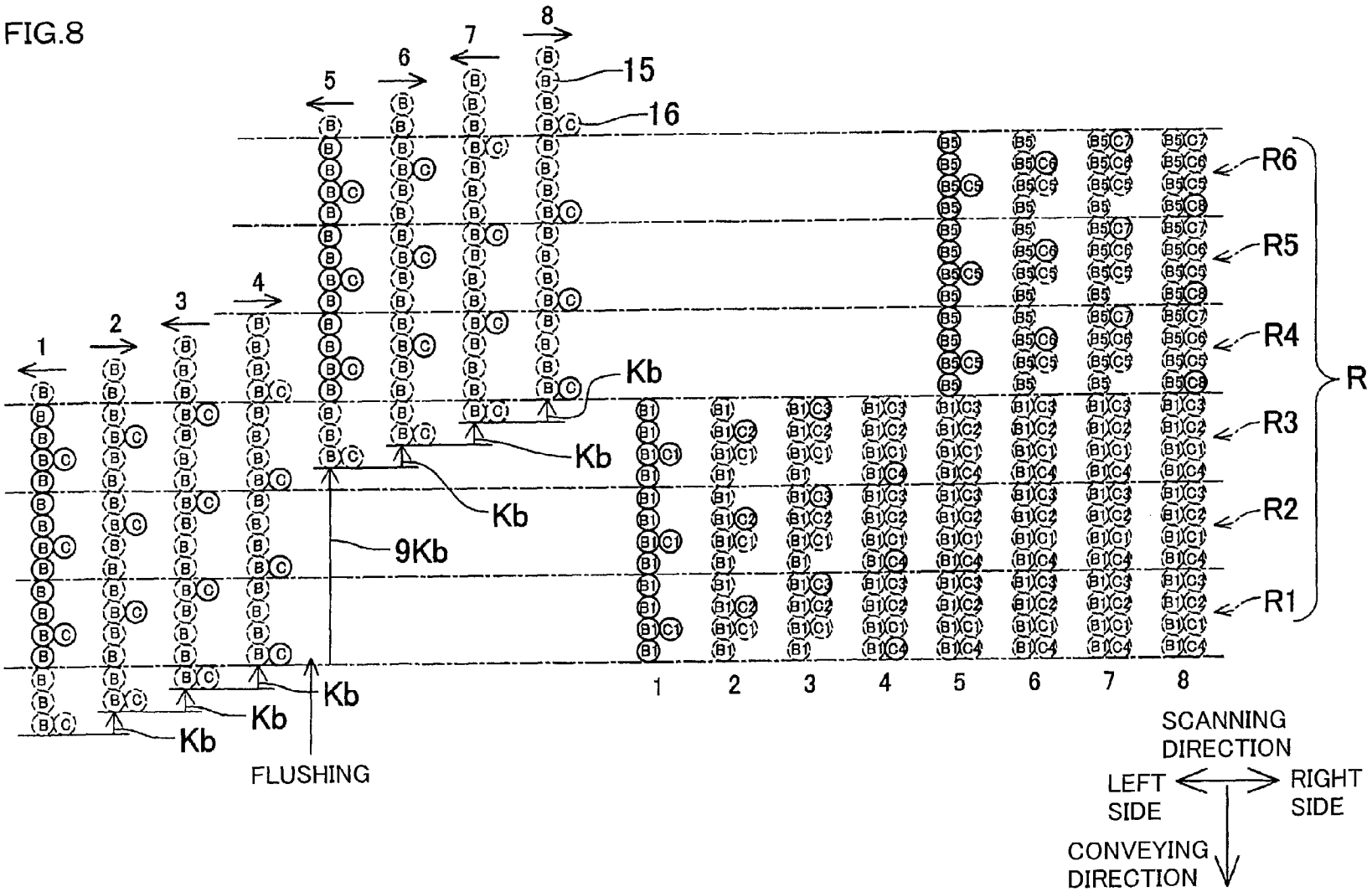
FIG. 8 is a diagram corresponding to FIG. 4 and illustrating one modification.
Figure 9:
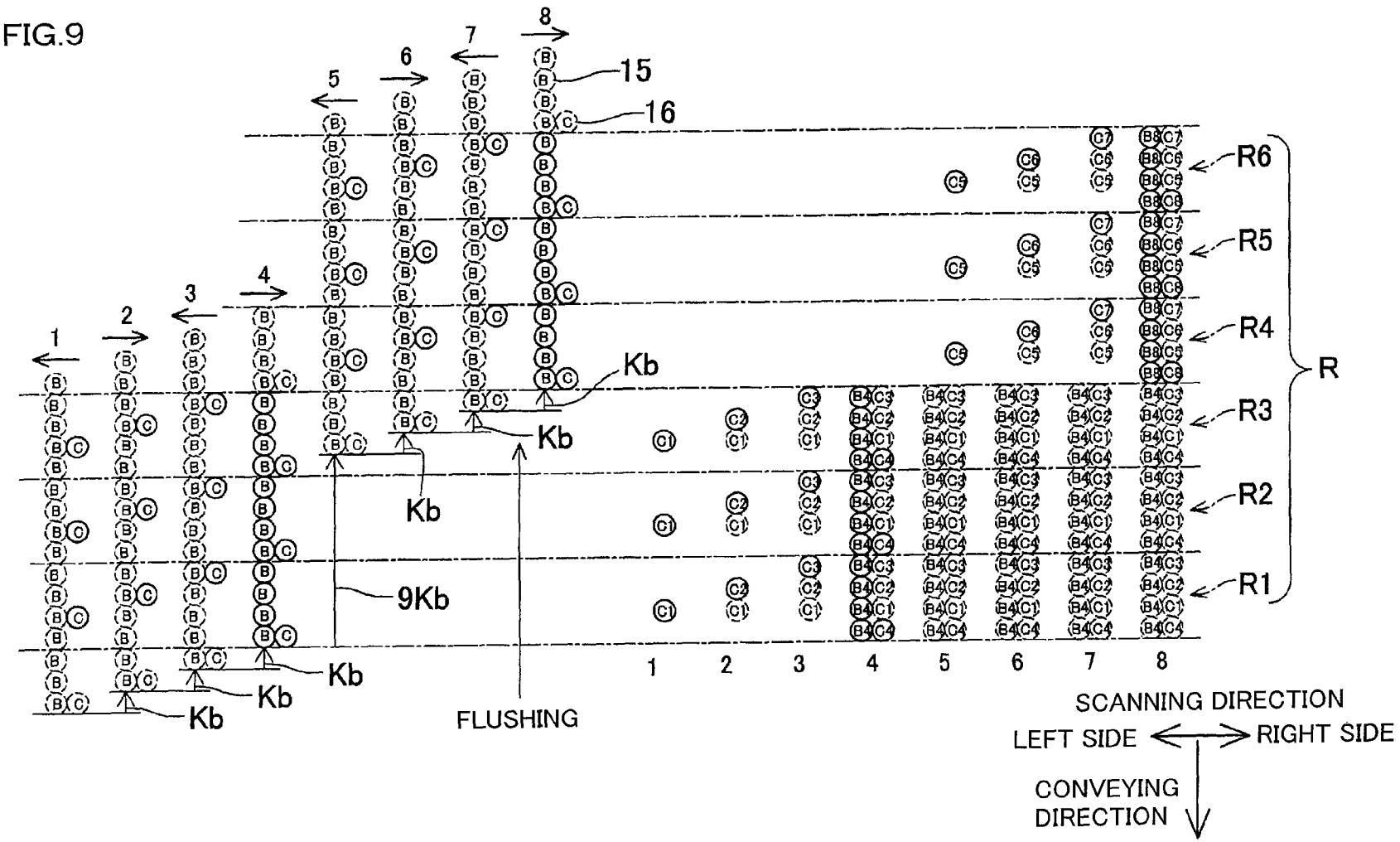
FIG. 9 is a diagram corresponding to FIG. 5 and illustrating one modification.

Furthermore, though the color nozzles 16 are aligned with an interval three times longer than that of the black nozzles 15 in the embodiment described above, the interval is not limited thereto. In one modification, as illustrated in FIGS. 8 and 9, the color nozzles 16 are aligned with an interval four times longer than the black nozzles 15. That is, Kn=4 Kb.

In the present modification, when an image is recorded in the first recording mode, as shown in FIG. 8, the first scanning is executed in which ink is ejected from both the black nozzles 15 and color nozzles 16 while the carriage 2 is moved to the left side in the scanning direction, and thereafter the recording sheet P is conveyed in the conveying direction by the same length as the interval Kb. Subsequently, the second through fourth scanning operations are executed in which ink is ejected only from the color nozzles 16 while the carriage 2 is moved to the right side, left side and right side alternately, and after the second and third scanning, the recording sheet P is conveyed by the same length as the interval Kb.

Note that, in the first to fourth scanning operations described above, ink is ejected only from the black nozzles 15 and color nozzles 16 set in the regions R1 through R3 among the black nozzles 15 and color nozzles 16. In the present modification, each of the regions R1 to R3 is a region in which four dots are aligned in the conveying direction. Thus, the first unit recording operation including the series of these operations allows the printer 1 to record an image in the regions R1 through R3 with a resolution corresponding to the interval Kb of the black nozzles 15.

Next, flushing is executed, and the recording sheet P is conveyed by the length of 9 Kb which is nine times the interval Kb, i.e. the length of Kb+2Kn which is obtained by adding a value corresponding to twice the interval Kn to the interval Kb, while the flushing is executed.

Subsequently, the first unit recording operation is executed again. That is, the fifth through eighth scanning operations are executed as in the first through fourth scanning operations, and after each of the fifth through seventh scanning operations, the recording sheet P is conveyed by the same interval as the interval Kb. In the fifth through eighth scanning operations, ink is ejected only from the black nozzles 15 and color nozzles 16 that are set in the regions R4 through R6. Accordingly, an image is recorded in the regions R4 through R6 with a resolution corresponding to the interval Kb of the black nozzles 15. It is noted that, in the present modification, each of the regions R4 through R6 is a region in which four dots are aligned in the conveying direction.

On the other hand, in the present modification, when an image is recorded in the second recording mode, the first scanning is executed in which ink is ejected only from the color nozzles 16 while the carriage 2 is moved to the left side in the scanning direction as shown in FIG. 9, and thereafter the recording sheet P is conveyed in the conveying direction by the same length as the interval Kb. Subsequently, the second and third scanning operations are executed in which ink is ejected from the color nozzles 16 while the carriage 2 is moved alternately to the right side and to the left side. Thereafter, the fourth scanning is executed in which ink is ejected from the black nozzles 15 and color nozzles 16 while the carriage 2 is moved to the right side. After the second and third scanning operations, the recording sheet P is conveyed by the same length as the interval Kb. Moreover, flushing is executed while the recording sheet P is being conveyed after the third scanning.

In the first to fourth scanning, ink is ejected only from the black nozzles 15 and color nozzles 16 that are set in the regions R1 through R3 among the black nozzles 15 and color nozzles 16. Accordingly, the second unit recording operation including the series of operations allows the printer 1 to record an image in the regions R1 through R3 with a resolution corresponding to the interval Kb of the black nozzles 15.

Next, the recording sheet P is conveyed by the length of 9 Kb which is nine times the interval Kb, and subsequently, the second unit recording operation is executed again. That is, the fifth through eighth scanning operations are executed as in the first through fourth scanning operations, and after the fifth through seventh scanning operations, the recording sheet P is conveyed by the same interval as the interval Kb. Moreover, flushing is executed while the recording sheet P is being conveyed after the seventh scanning. In the fifth through eighth scanning, ink is ejected only from the black nozzles 15 and color nozzles 16 that are set in the regions R4 through R6. This allows the printer 1 to record an image in the regions R4 through R6 with a resolution corresponding to the interval Kb of the black nozzles 15.

Also in the present modification, as in the embodiment described above, the first recording mode is set to record an image so that an image can be recorded with black ink standing out, and the second recording mode is set to record an image so that an image can be recorded with color ink standing out.

Moreover, as in the embodiment described above, an image recorded in the first recording mode or the second recording mode will not have a mixture of a portion where black ink stands out and a portion where color ink stands out. Thus, non-uniformity is unlikely to occur between portions in a recorded image. Furthermore, an image can be recorded in a significantly short period of time.

Moreover, since the color nozzles 16 are aligned at an interval which is four times the interval of the black nozzles 15 in the present modification, four scanning operations are executed in the first and second unit recording operations. Thus, at the first scanning and the last scanning in the first and second unit recording operations, the carriage 2 is moved in opposite directions. Therefore, scanning can be executed in series in the first unit recording operation or the second unit recording operation without blank scanning as in the embodiment described above.

In addition, the interval of color nozzles 16 is not limited to three or four times the interval of black nozzles 15 but may be twice, or five or more times (the number being an integer) the interval of black nozzles 15. Furthermore, though the recording sheet P is conveyed by the same length as the interval Kb after each scanning except for the last scanning in the first and second unit recording operations in the description above, an employable configuration is not limited thereto. The recording sheet P may alternatively be conveyed by the same length as the interval of 4 Kb or the interval of 7 Kb.

Moreover, the embodiment and modification above described that flushing is executed after the first unit recording operation and before the subsequent first unit recording operation and also immediately before the last scanning in the second unit recording operation, i.e., before ink is ejected from both the black nozzles 15 and color nozzles 16 in each of the first unit recording operation and second unit recording operation. However, in the case where, for example, it takes only a short time to perform each of the first and second unit recording operations and thus ink in the black nozzles 15 does not become so dry during a period after ink is ejected from the black nozzles 15 until ink is ejected again from the black nozzles 15, it is not necessary to execute flushing.

Furthermore, though the embodiment and modification above described a configuration in which an image can selectively be recorded in any one of the first recording mode and the second recording mode when the image is recorded by ejecting black ink and color ink superposed on each other, an employable configuration is not limited to such a configuration.

For example, when an image is recorded by ejecting black ink and color ink superposed on each other, an image may be recorded always in the first recording mode or always in the second recording mode.

In addition, though an example was described above in which an application is made to a printer comprising the ink jet head 3 provided with the black nozzles 15 ejecting black ink and the color nozzles 16 ejecting color ink, an employable configuration is not limited thereto. The combination of a type of ink ejected from the first nozzles aligned with a predetermined interval D1 and a type of ink ejected from the second nozzles aligned with a predetermined interval sD1 (s is an odd number equal to or larger than 3) may be a different combination not limited to include black ink and color ink.

According to the present embodiment, it is possible to selectively record any one of an image in which the first ink stands out and an image in which the second ink stands out.

According to the present embodiment, which one of the first and second recording modes is set to record an image is determined in accordance with mode information, so that an image can be recorded with an image quality corresponding to an image to be recorded.

According to the present embodiment, a character to be recorded is highlighted with black ink, so that the visibility of characters in a recorded image is increased.

When the first unit recording operation is repeatedly executed, the first ink will not be ejected from the first nozzles after the first ink is ejected from the first nozzles at the first movement of a carriage in the first unit recording operation until the first movement of the carriage in the next first unit recording operation. Thus, ink in the first nozzles may be dried by the time the next first unit recording operation is executed and the first ink may not normally be ejected from the first nozzles in the next first unit recording operation. To address such a problem, in the present embodiment, flushing is performed after the first unit recording operation and before the next first unit recording operation. This allows the first nozzles to normally eject the first ink in the next first unit recording operation.

When the interval of the second nozzles corresponds to an odd number times the interval of the first nozzles, the number of carriage movements in a unit recording operation corresponds to the above-described odd number, which causes the carriage to move in the same direction at the first and last movements. On the other hand, in the present embodiment, a carriage is moved to a direction opposite from a direction of the last movement of the carriage without ejecting ink after the last movement of the carriage in a unit recording operation and before the next unit recording operation. This allows the unit recording operation to repeatedly and sequentially be performed. Moreover, the carriage is moved at a speed higher than that in the unit recording operation, which can reduce the time required for recording an image.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An image recording apparatus, comprising:

an ink jet head ejecting ink from a plurality of nozzles;

a carriage equipped with the ink jet head and reciprocating in a predetermined moving direction;

a conveyance mechanism conveying a recording medium to which ink is ejected from the nozzles in a conveying direction perpendicular to the moving direction; and a control section controlling operations of the ink jet head, the carriage and the conveyance mechanism, wherein the ink jet head is provided with:

a plurality of first nozzles aligned with an interval D1 in the conveying direction and ejecting first ink; and a plurality of second nozzles positioned on one side in the moving direction with respect to the plurality of first nozzles and aligned with an interval nD1 (n is an integer larger than 1) in the conveying direction, and ejecting second ink of a type different from the first ink, the control section repeatedly executes a unit recording operation in which the carriage is moved alternately to the one side and to another side in the moving direction for n times, while ink is ejected from at least one of the plurality of first nozzles and the plurality of second nozzles and the conveyance mechanism conveys a recording medium in the conveying direction by a length of (1+mn)D1 (m is 0 or an arbitrary natural number) every time the moving direction of the carriage is inverted, the control section causes both the plurality of first nozzles and the plurality of second nozzles to eject ink at first movement of the carriage in which a direction of the first movement of the carriage is toward the another side or at last movement of the carriage in which a direction of the last movement of the carriage is toward the one side among n movements of the carriage, and the control section causes only the plurality of second nozzles to eject ink at movement of the carriage except for the first movement or the last movement among n movements of the carriage.

2. The image recording apparatus according to claim 1, wherein the control section determines which one of recording modes is set between a first recording mode in which the unit recording operation for moving the carriage so that the direction of the first movement of the carriage is toward the another side is repeatedly executed, and a second recording mode in which the unit recording operation for moving the carriage so that the direction of the last movement of the carriage is toward the one side is repeatedly executed, and the control section controls the operations of the ink jet head, the carriage and the conveyance mechanism based on a determination result.

3. The image recording apparatus according to claim 2, wherein the control section acquires image data of an image to be recorded and mode information indicating the recording mode corresponding to the image data, the control section determines which one of the recording modes is set between the first recording mode and the second recording mode based on the acquired mode information, and the control section controls the operations of the ink jet head, the carriage and the conveyance mechanism based on a determination result, to record an image of the acquired image data on a recording medium.

4. The image recording apparatus according to claim 3, wherein the first ink is black ink, the second ink is color ink, the control section acquires a data format of the image data as the mode information, and the control section determines to set the first recording mode when the acquired data format is a data format including character data.

5. The image recording apparatus according to claim 3, wherein the first ink is black ink, the second ink is color ink, the control section acquires a data format of the image data as the mode information, and the control section determines to set the second recording mode when the acquired data format is a data format including photograph data.

6. The image recording apparatus according to claim 1, wherein the control section executes flushing for ejecting the first ink from the plurality of first nozzles at a position where no ink is ejected to a recording medium after the unit recording operation and before a next unit recording operation, when the carriage is so moved that the direction of the first movement of the carriage is toward the another side.

7. The image recording apparatus according to claim 1, wherein the control section executes flushing for ejecting the first ink from the plurality of first nozzles at a position where no ink is ejected to a recording medium before ink is ejected from both the plurality of first nozzles and the plurality of second nozzles.

8. The image recording apparatus according to claim 1, wherein the control section moves the carriage in a direction opposite from the direction of the last movement of the carriage in the unit recording operation at a speed higher than a speed in the unit recording operation without the first nozzles and the second nozzles ejecting ink after the unit recording operation and before a next unit recording operation, when a value of n is an odd number.

* * * * *